US008382649B2

(12) United States Patent
Salvesen

(10) Patent No.: US 8,382,649 B2
(45) Date of Patent: Feb. 26, 2013

(54) DELIVERING FOIL LEAVES OF SELECTED LENGTHS FROM AN INDETERMINATE LENGTH OF FOIL

(75) Inventor: William R. Salvesen, Brooklyn, NY (US)

(73) Assignee: Peter W. Salvesen, Bailey, CO (US)

( * ) Notice: Subject to any disclaimer, the term of this patent is extended or adjusted under 35 U.S.C. 154(b) by 0 days.

(21) Appl. No.: 13/399,114

(22) Filed: Feb. 17, 2012

(65) Prior Publication Data

US 2012/0144970 A1 Jun. 14, 2012

Related U.S. Application Data

(62) Division of application No. 12/861,371, filed on Aug. 23, 2010, now Pat. No. 8,142,341.

(51) Int. Cl.
*B31B 1/14* (2006.01)

(52) U.S. Cl. ..... 493/356; 493/405

(58) Field of Classification Search ..... 493/356, 493/405, 352, 366; 132/208, 200
See application file for complete search history.

(56) References Cited

U.S. PATENT DOCUMENTS 3,792,672 A 2/1974 Friedman et al.
3,799,468 A 3/1974 Caple et al.
4,130,038 A 12/1978 Zehnder
4,196,647 A 4/1980 Fish
4,417,495 A 11/1983 Gordon et al.
4,488,466 A 12/1984 Jones
4,579,267 A * 4/1986 Planke ..... 225/54
4,586,639 A 5/1986 Ruff et al.
4,787,542 A 11/1988 Ruff et al.
4,832,271 A 5/1989 Geleziunas
5,989,173 A 11/1999 Lugea et al.
6,237,608 B1 5/2001 Kari
6,725,753 B2 4/2004 Bell
7,354,639 B2 4/2008 Durney et al.

* cited by examiner

*Primary Examiner* — Sameh H. Tawfik
(74) *Attorney, Agent, or Firm* — Arthur Jacob

(57) ABSTRACT

A method and apparatus deliver consecutive foil leaves for use by a hair stylist during the course of a hair styling procedure. Each leaf is of a selected length severed from a supply of foil of indeterminate length, with a unitary tab folded along a fold line extending across the leaf, adjacent a leading edge of the leaf. The foil preferably is drawn from a roll of foil and is advanced along a feed path to a delivery station, and a cutter and folder are moved across the feed path to sever the leaf from the indeterminate length of foil and establish the tab adjacent the leading edge of the leaf. In the preferred arrangement, the cutter and the folder are moved simultaneously along respective arcuate paths by pivotal movement about a common pivotal axis.

5 Claims, 4 Drawing Sheets

DELIVERING FOIL LEAVES OF SELECTED LENGTHS FROM AN INDETERMINATE LENGTH OF FOIL

CROSS-REFERENCE TO RELATED APPLICATION

This application is a division of application Ser. No. 12/861,371, filed Aug. 23, 2010.

BACKGROUND OF THE INVENTION

1. Field of the Invention

The present invention relates generally to the provision of foil leaves utilized in the conduct of certain hair treatment and styling procedures in hair salons and pertains, more specifically, to facilitating the delivery of such foil leaves to a hair stylist in a hair salon with increased convenience, ease and economy.

Over the ages, women have sought to enhance their appearance through treatments directed toward rendering their hair more attractive. Among the more popular procedures carried out in hair salons are a number of techniques which have been developed for accomplishing changes in the color of selected sections of hair, utilizing various operations, and utensils designed to facilitate such operations.

2. Description of Related Art

One of the more ubiquitous techniques currently employed in hair salons for changing hair color in selected sections of hair utilizes multiple leaves of foil, usually a metal foil such as aluminum foil, to isolate selected sections of hair for treatment. Each section of hair is laid upon a corresponding leaf of foil, treated by applying an appropriate treatment solution to the isolated section of hair, and then is wrapped within the foil leaf as further sections subsequently are isolated, treated and wrapped, until all selected sections have been treated. In the preferred configuration, each foil leaf is provided with a tab folded along one edge of the leaf for facilitating handling and support of the foil leaf during the course of the hair styling process. Upon the expiration of the time needed for the desired reaction to take place between each section of hair and the applied solution, the foil leaves are removed and are discarded, leaving behind the treated sections, ready for subsequent washing and styling to complete the beautification process.

BRIEF SUMMARY OF THE INVENTION

Usually, the foil leaves are made available to the hair stylist in boxes of individual leaves, configured for immediate use, with all of the leaves in a given box being of the same dimensions, thus requiring not only an inventory of multiple boxes of foil leaves of different dimensions, and a concomitant large stock of boxes, but also requiring that a smaller supply of different sizes be made available immediately at hand during each styling operation, leading to inconvenience, inefficiency and waste. The present invention delivers to the hair stylist foil leaves of selected size, configured for immediate use, as needed, with added convenience and versatility, and increased economy. As such, the present invention attains several objects and advantages, some of which are summarized as follows: Delivers consecutive foil leaves directly to a hair stylist, as needed, in lengths selected by the stylist during the conduct of a styling operation; severs individual foil leaves consecutively from a supply of foil of indeterminate length, as needed during a styling operation, for greater versatility, added convenience and increased economy; eliminates the requirement for maintaining an inventory of individual foil leaves of different dimensions, in favor of a single supply of foil of indeterminate length, thereby dramatically reducing cost; severs each foil leaf from a supply of foil of indeterminate length, as required, in any selected length, and configures each severed leaf for immediate use upon delivery to a stylist; simplifies a hair styling procedure of the kind requiring the use of foil leaves by delivery directly to a hair stylist foil leaves of selected length and desired configuration, ready for immediate use upon delivery; provides apparatus which is relatively simple in construction and use for ready and convenient operation by a hair stylist during the course of a styling operation requiring multiple foil leaves of selected lengths; facilitates the conduct of a hair styling operation through utilization of a simple, effective and reliable procedure for delivery to a hair stylist foil leaves of selected lengths, configured for immediate use; provides a rugged apparatus of relatively simple construction capable of economical manufacture and reliable operation to deliver foil leaves, as needed, over an extended service life.

The above objects and advantages, as well as further objects and advantages, are attained by the present invention which may be described briefly as apparatus for delivering consecutive foil leaves, each leaf being of a selected length severed from a supply of foil of indeterminate length, with a unitary tab folded along a fold line extending across the leaf, adjacent a leading edge of the leaf, the apparatus comprising: a frame; a supply station on the frame for holding a supply of foil of indeterminate length; a delivery station spaced from the supply station along a feed path extending in a forward direction from the supply station to the delivery station; a folding station located between the supply station and the delivery station; a platform juxtaposed with the feed path and having a forward edge located at the folding station; a shearing blade mounted on the frame and having a shearing edge extending across the feed path and spaced forward of the forward edge of the platform by a gap between the forward edge of the platform and the shearing edge of the shearing blade; a cutter having a cutting edge extending across the feed path, the cutter being mounted on the frame for movement of the cutting edge along a cutting path extending transverse to the feed path, the cutting path passing through the feed path, at the gap, and intercepting the feed path in shearing juxtaposition with the shearing edge of the shearing blade such that the foil will be sheared along the shearing edge as the cutting edge is moved along the cutting path and through the gap to sever a leaf from the indeterminate length of foil and thereby deliver the severed leaf at the delivery station, while leaving a severed edge of the indeterminate length of foil extending across the feed path in juxtaposition with the shearing edge; and a folder having a folding member extending across the feed path, the folder being mounted on the frame for movement of the folding member along a folding path extending transverse to the feed path, the folding path passing through the feed path, at the gap, and intercepting the feed path in folding juxtaposition with the forward edge of the platform; the folding member being located relative to the cutting edge so as to intercept the feed path subsequent to interception of the cutting edge with the feed path as the cutting edge and the folding member are moved through the feed path and into the gap, so as to engage the folding member with a segment of the foil extending between the forward edge of the platform and the severed edge of the foil and fold the segment about the forward edge, along a fold line defined by the forward edge of the platform, to establish simultaneously a tab between the fold line and the severed edge of the indeterminate length of foil and, at the fold line, the leading edge of a next-consecutive foil leaf.

In addition, the present invention provides a method for delivering consecutive foil leaves, each leaf being of a selected length severed from a supply of foil of indeterminate length, with a unitary tab folded along a fold line extending across the leaf, adjacent a leading edge of the leaf, the method comprising: providing a supply of foil of indeterminate length at a supply station; advancing the foil along a feed path extending in a forward direction from the supply station to a delivery station; juxtaposing a platform with the feed path, the platform having a forward edge located at a folding station placed between the supply station and the delivery station; providing a shearing blade having a shearing edge extending across the feed path and spaced forward of the forward edge of the platform by a gap between the forward edge of the platform and the shearing edge of the shearing blade; providing a cutter having a cutting edge extending across the feed path; moving the cutting edge along a cutting path extending transverse to the feed path, the cutting path passing through the feed path, at the gap, and intercepting the feed path in shearing juxtaposition with the shearing edge of the shearing blade such that the foil is sheared along the shearing edge as the cutting edge is moved along the cutting path and through the gap to sever a leaf from the indeterminate length of foil and thereby deliver the severed leaf at the delivery station, while leaving a severed edge of the indeterminate length of foil extending across the feed path in juxtaposition with the shearing edge; providing a folder having a folding member extending across the feed path; and moving the folding member along a folding path extending transverse to the feed path, the folding path passing through the feed path, at the gap, and intercepting the feed path in folding juxtaposition with the forward edge of the platform; the folding member being located relative to the cutting edge so as to intercept the feed path subsequent to interception of the cutting edge with the feed path as the cutting edge and the folding member are moved through the feed path and into the gap, so as to engage the folding member with a segment of the foil extending between the forward edge of the platform and the severed edge of the foil and fold the segment about the forward edge, along a fold line defined by the forward edge of the platform, to establish simultaneously a tab between the fold line and the severed edge of the indeterminate length of foil and, at the fold line, the leading edge of a next-consecutive foil leaf.

BRIEF DESCRIPTION OF THE SEVERAL VIEWS OF THE DRAWING

The invention will be understood more fully, while still further objects and advantages will become apparent, in the following detailed description of preferred embodiments of the invention illustrated in the accompanying drawing, in which.

DETAILED DESCRIPTION OF THE INVENTION

Figure 1:
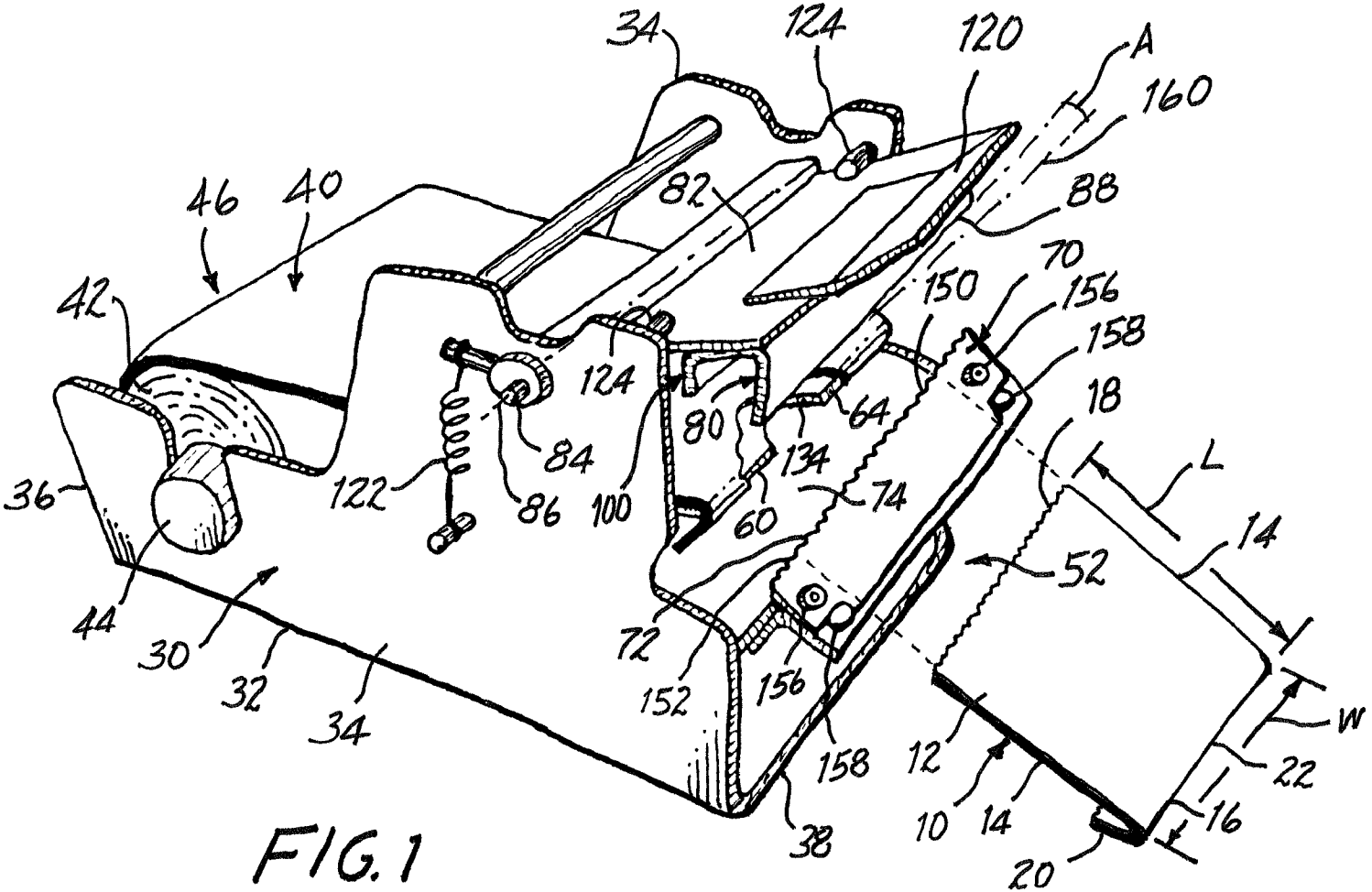
FIG. 1 is a pictorial view depicting an apparatus constructed in accordance with the present invention, operated in accordance with a method of the present invention.
Figure 2:
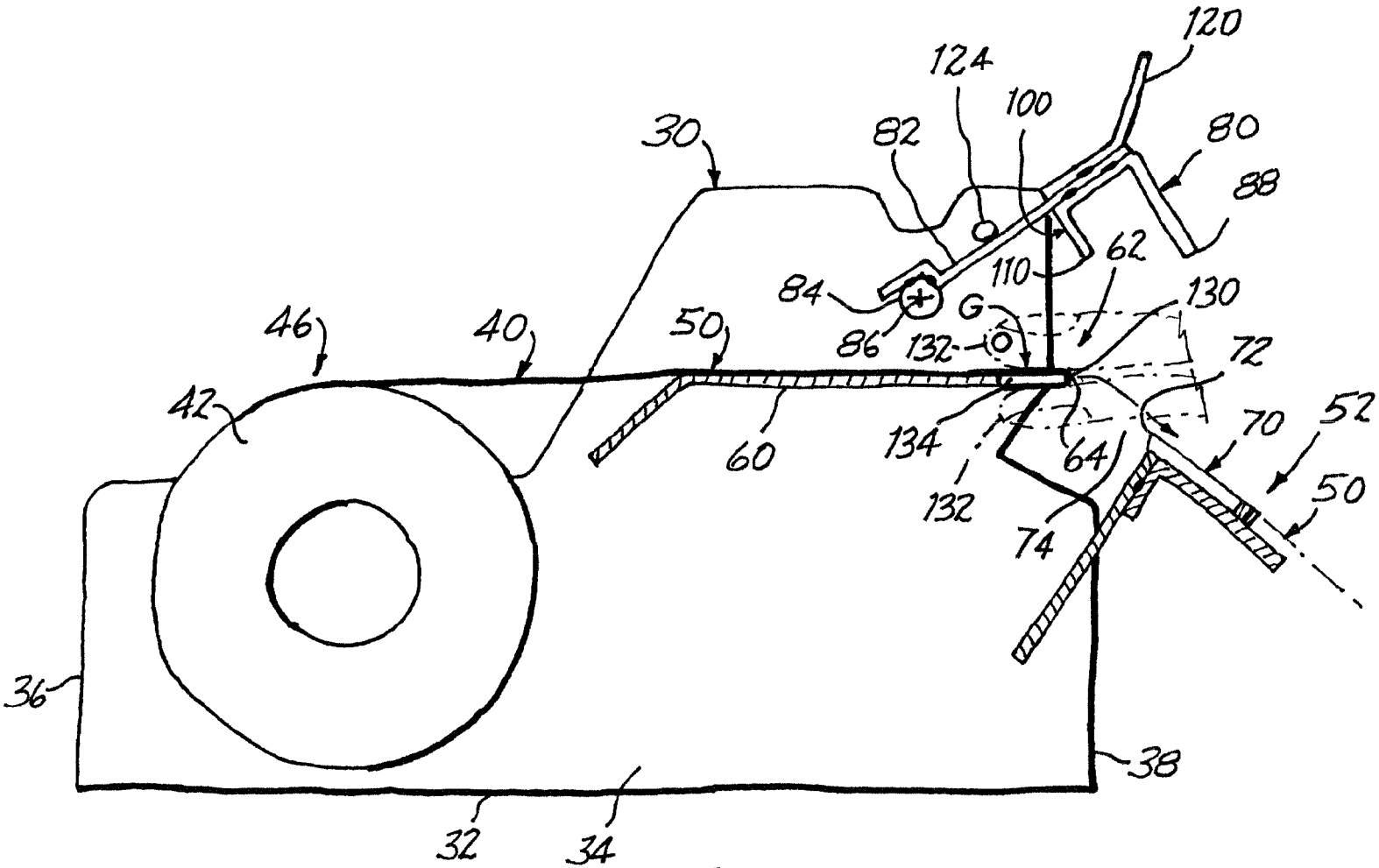
FIG. 2 is a largely diagrammatic longitudinal cross-sectional view of the apparatus showing internal details of construction.

Referring now to the drawing, and especially to FIGS. 1 and 2 thereof, a foil leaf to be used in connection with a hair styling procedure, as set forth above, is shown at 10 and is seen to include a body 12 having a predetermined lateral width W extending between opposite sides 14, and a longitudinal length L extending between a leading edge 16 and a trailing edge 18. A tab 20 is unitary with body 12 and is folded about a fold line 22 extending laterally across foil leaf 10 between the opposite sides 14 so as to be juxtaposed with body 12 adjacent the leading edge 16, thereby establishing a configuration facilitating use of foil leaf 10 in the described hair styling operation.

An apparatus constructed in accordance with the present invention is shown at 30 and includes a frame 32 having laterally opposite side walls 34 extending longitudinally between a rearward end 36 and a forward end 38 of frame 32. A supply of foil 40 is furnished in the form of a roll 42 of foil 40, providing a very extensive supply of foil 40 of indeterminate length. Roll 42 is placed upon an arbor 44, supported in frame 32 so as to be journaled for rotation within the frame 32 at a supply station 46 located adjacent the rearward end 36 of the frame 32 for feeding foil 40 as foil 40 is advanced along a feed path 50 to a delivery station 52 located adjacent the forward end 38 of frame 32.

A platform 60 is juxtaposed with the feed path 50 between the supply station 46 and a folding station 62 located longitudinally between the supply station 46 and the delivery station 52. The platform 60 is integral with frame 32, extends laterally between opposite side walls 34 of frame 32 and passes altitudinally beneath the feed path 50 such that foil 40 is drawn over platform 60 as the foil 40 is advanced along feed path 50 from supply station 46 to delivery station 52. Platform 60 includes a forward edge 64 facing forward and extending laterally across the feed path 50. A shearing blade 70 is mounted on frame 32 adjacent the delivery station 52 and includes a shearing edge 72 extending laterally across feed path 50, beneath the feed path 50, and spaced forward of the forward edge 64 of platform 60 by a gap 74 between the forward edge 64 and the shearing edge 72.

A cutter 80 is carried by an arm 82 affixed to a shaft 84 extending laterally across frame 32 and journaled within side walls 34 for pivotal movement about a lateral pivotal axis 86 located altitudinally above feed path 50. Cutter 80 depends downwardly from arm 82 and includes a cutting edge 88 extending laterally across feed path 50 such that cutting edge 88 is movable along a curved path shown in the form of arcuate cutting path 90 (see FIG. 3) extending transverse to feed path 50, the cutting path 90 passing through the feed path 50, at the gap 74, and intercepting feed path 50 in shearing juxtaposition with shearing edge 72. A folder 100 is carried by arm 82 and includes a folding member 110 depending from arm 82 and extending laterally across feed path 50, the folding member 110 being movable along a curved path shown in the form of arcuate folding path 112 (see FIG. 3) extending transverse to feed path 50, the folding path 112 passing through the feed path 50, at the gap 74, and intercepting the feed path 50 in folding juxtaposition with the forward edge 64 of the platform 60. Arm 82 includes an actuator handle in the form of a bar 120 extending laterally between the side walls 34 of frame 32, and a spring 122 biases the arm 82 into a retracted position, against rest stops 124, as illustrated in FIG. 2.

Figure 3:
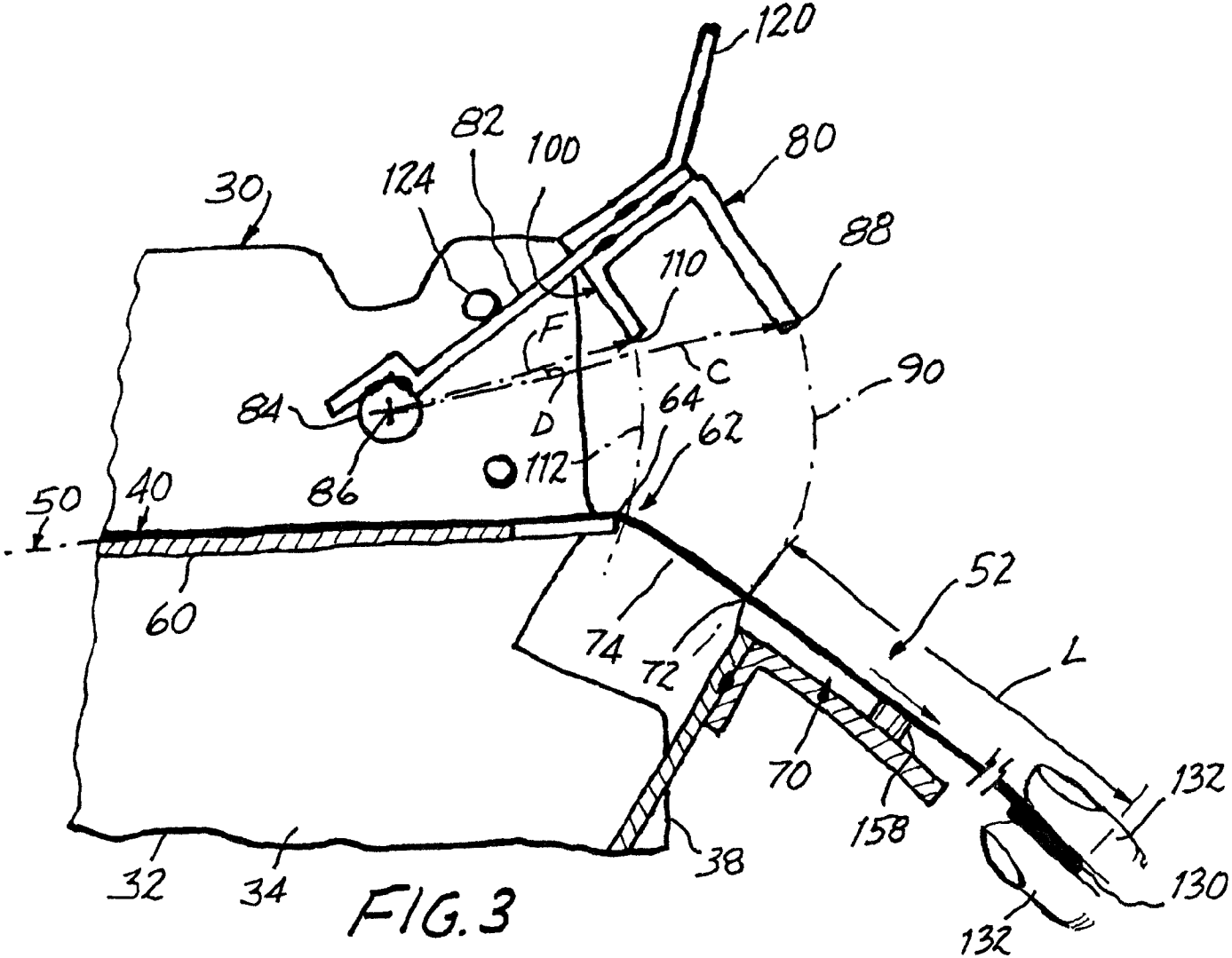
FIG. 3 is a largely diagrammatic fragmentary cross-sectional view of a portion of FIG. 2, and depicting a stage of operation of the apparatus in accordance with a method of the present invention.

Turning now to FIGS. 3 through 6, as well as with reference to FIGS. 1 and 2, when it is desired to deliver a foil leaf 10 for use by a hair stylist during a hair styling procedure, the hair stylist will reach into gap 74 and grasp foil 40 at a leading edge 130, as illustrated at G in FIG. 2, wherein fingers of the hair stylist are depicted in phantom at 132 and are shown gripping the foil 40 at leading edge 130 to draw the foil forward along feed path 50, across gap 74, toward delivery station 52, as seen in FIG. 3. The grip at G is facilitated by the provision of a finger recess 134 at the forward edge 64 of platform 60, located intermediate the side walls 34 of frame 32, as illustrated in FIG. 1.

Figure 4:
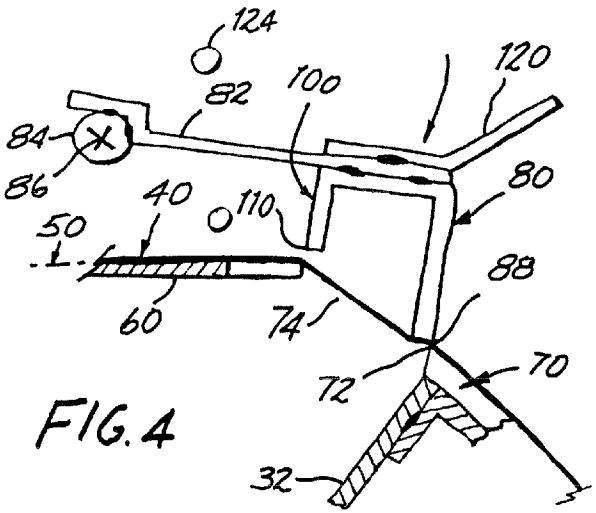
FIG. 4 is a largely diagrammatic fragmentary cross-sectional view of a portion of FIG. 2, and depicting another stage of operation of the apparatus in accordance with a method of the present invention.

Foil 40 then is drawn manually from roll 42 and advanced along feed path 50 until the hair stylist determines visually that a selected length L has been delivered between leading edge 130 of foil 40 and shearing edge 72 of shearing blade 70, as depicted in FIG. 3. Then, the hair stylist will push generally downwardly upon bar 120, as seen in FIGS. 3 and 4, pivoting arm 82 about pivotal axis 86, and moving cutting edge 88 along cutting path 90 until cutting edge 88 intersects feed path 50 and engages foil 40 in shearing juxtaposition with shearing edge 72. As cutting edge 88 continues along cutting path 90, cutting edge 88 passes through feed path 50 and shears foil leaf 10 from the indeterminate length of foil 40, whereby a foil leaf 10 of selected length L is delivered to the hair stylist at delivery station 52, as shown in FIG. 5, while leaving behind a severed edge 136 at the terminal end of foil 40.

Figure 5:
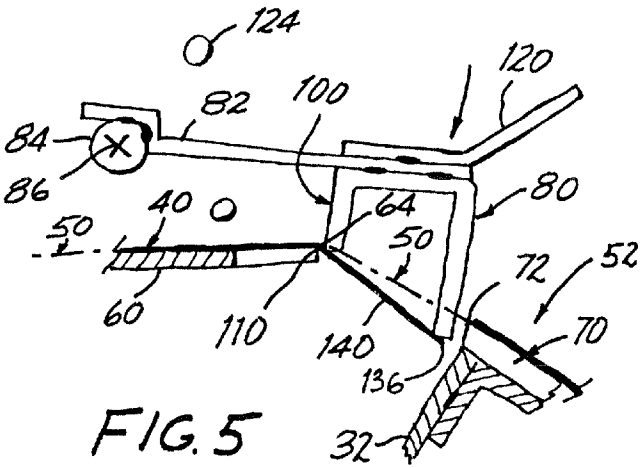
FIG. 5 is a largely diagrammatic fragmentary cross-sectional view of a portion of FIG. 2, and depicting still another stage of operation of the apparatus in accordance with a method of the present invention.
Figure 6:
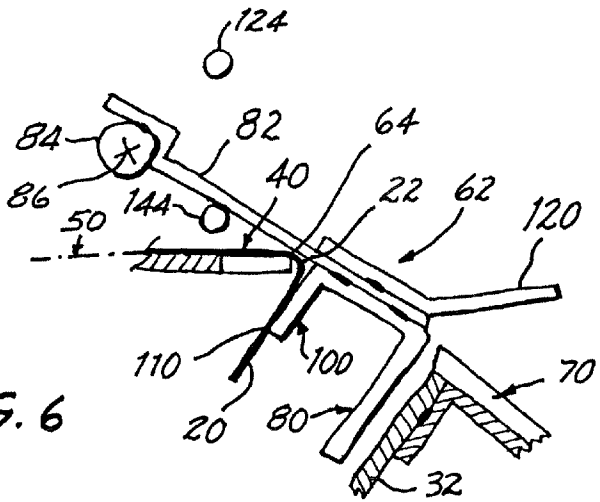
FIG. 6 is a largely diagrammatic fragmentary cross-sectional view of a portion of FIG. 2, and depicting yet another stage of operation of the apparatus in accordance with a method of the present invention.

Continued pivotal movement of arm 82 downwardly effects a simultaneous pivotal movement of folding member 110 about the common pivotal axis 86, along folding path 112 until folding member 110 intersects feed path 50 and engages foil 40 in folding juxtaposition with forward edge 64 of platform 60, as seen in FIG. 5. As folding member 110 continues along folding path 112, folding member 110 passes through feed path 50 to engage and fold a segment 140 of foil 40, which segment 140 extends between forward edge 64 of platform 60 and severed edge 136 of foil 40 and spans gap 74, to establish tab 20 folded along fold line 22, as illustrated in FIG. 6, ready to be grasped for delivering a next-consecutive foil leaf 10.

As shown diagrammatically in FIGS. 3 through 6, cutting edge 88 and folding member 110 are located relative to one-another such that foil 40 first is sheared at shearing edge 72 and then segment 140 of foil 40 is engaged immediately after shearing to fold tab 20 along fold line 22. To that end, folding member 110 lags behind cutting edge 88 as arm 82 is pivoted downwardly about pivotal axis 86 to move the cutting edge 88 along cutting path 90 and the folding member 110 along folding path 112; that is, cutting edge 88 lies on a cutting radius of curvature C of arcuate cutting path 90, while folding member 110 lies on a folding radius of curvature F of arcuate folding path 112, with radius F being less than radius C and spaced a relatively small angular distance D behind radius C, angular distance D being of sufficient magnitude to assure that folding member 110 is spaced away from foil 40 located along feed path 50 at folding station 62 when cutting edge 88 reaches the foil 40 in shearing juxtaposition with shearing edge 72, and does not reach folding juxtaposition with forward edge 64 of platform 60 until after foil leaf 10 is severed from indeterminate length of foil 40. In this manner, a single sweep of arm 82 from the retracted position illustrated in FIGS. 1 through 3, to the fully-actuated position illustrated in FIG. 6, severs a foil leaf 10 of selected length L from the indeterminate length of foil 40 and readies foil 40 for the delivery of a next-consecutive severed foil leaf 10. In the fully-actuated position, arm 82 is depressed and comes to rest against stops 144 which are affixed to frame 32. Upon release of bar 120, spring 122 will return arm 82 to the retracted position, wherein arm 82 is biased by spring 122 against stops 124, and apparatus 30 will be ready for the delivery of another foil leaf 10 of any selected length L, as determined by the hair stylist. It is noted that in addition to providing the desired tab 20 folded along fold line 22 of a severed foil leaf 10, the establishment of tab 20 at leading edge 130 of foil 40 provides a convenient and somewhat reinforced gripping site on foil 40, facilitating the grasping and manual advancement of foil 40 along feed path 50, as described above, while resisting unwanted distortion of foil 40 and foil leaf 10.

Returning now to FIG. 1, in the preferred construction, shearing edge 72 includes an undulate configuration 150 providing sharp teeth 152 which effectively will penetrate foil 40 and facilitate the shearing of foil leaf 10 from foil 40 over an extended service life. However, should it become necessary to replace shearing blade 70, such replacement is accomplished readily merely by removing mounting screws 156 to release shearing blade 70 from frame 32. Upon placing a replacement shearing blade 70 in apparatus 30, the replacement shearing blade 70 is accurately located by engagement against blade stops 158 affixed to frame 32 for precisely positioning the shearing blade 70 prior to securing the shearing blade 70 in place on frame 32. In order to facilitate shearing of each foil leaf 10 from the indeterminate length of foil 40, cutting edge 88 preferably extends along a slight angle A relative to the direction 160 of shearing edge 72 so that shearing is accomplished gradually as the cutting edge 88 passes through feed path 50 at the shearing edge 72.

By enabling a hair stylist to draw any length of foil 40 from roll 42, the hair stylist can select any desired length L for a foil leaf 10 as needed during the course of conducting a hair styling procedure, without having to select from only fixed sizes made available at a particular work station. Moreover, the ability to make available any desired length of foil leaf 10 close at hand, without the necessity for maintaining an inventory of individual foil leaves of multiple fixed sizes, not only increases versatility and convenience in providing a precise desired size, but enables greater economy through the use of a roll 42 of foil 40 which is capable of supplying many more foil leaves 10 at a very much reduced cost over individually packaged foil leaves of fixed sizes.

It will be seen that the present invention attains all of the objects and advantages summarized above, namely: Delivers consecutive foil leaves directly to a hair stylist, as needed, in lengths selected by the stylist during the conduct of a styling operation; severs individual foil leaves consecutively from a supply of foil of indeterminate length, as needed during a styling operation, for greater versatility, added convenience and increased economy; eliminates the requirement for maintaining an inventory of individual foil leaves of different dimensions, in favor of a single supply of foil of indeterminate length, thereby dramatically reducing cost; severs each foil leaf from a supply of foil of indeterminate length, as required, in any selected length, and configures each severed leaf for immediate use upon delivery to a stylist; simplifies a hair styling procedure of the kind requiring the use of foil leaves by delivery directly to a hair stylist foil leaves of selected length and desired configuration, ready for immediate use upon delivery; provides apparatus which is relatively simple in construction and use for ready and convenient operation by a hair stylist during the course of a styling operation requiring multiple foil leaves of selected lengths; facilitates the conduct of a hair styling operation through utilization of a simple, effective and reliable procedure for delivery to a hair stylist foil leaves of selected lengths, configured for immediate use; provides a rugged apparatus of relatively simple construction capable of economical manufacture and reliable operation to deliver foil leaves, as needed, over an extended service life.

It is to be understood that the above description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. A method for delivering consecutive foil leaves, each leaf being of a selected length severed from a supply of foil of indeterminate length, with a leading edge and a unitary tab folded along a fold line extending across the leaf, at the leading edge of the leaf, the method comprising:

providing a supply of foil of indeterminate length at a supply station;

advancing the foil along a feed path extending in a forward direction from the supply station to a delivery station;

juxtaposing a platform with the feed path, the platform having a forward edge located at a folding station placed between the supply station and the delivery station;

providing a shearing blade having a shearing edge extending across the feed path and spaced forward of the forward edge of the platform by a gap between the forward edge of the platform and the shearing edge of the shearing blade;

providing a cutter having a cutting edge extending across the feed path;

moving the cutting edge along a cutting path extending transverse to the feed path, the cutting path passing through the feed path, at the gap, and intercepting the feed path in shearing juxtaposition with the shearing edge of the shearing blade such that the foil is sheared along the shearing edge as the cutting edge is moved along the cutting path and through the gap to sever a leaf from the indeterminate length of foil and thereby deliver the severed leaf at the delivery station, while leaving a severed edge of the indeterminate length of foil extending across the feed path in juxtaposition with the shearing edge;

providing a folder having a folding member extending across the feed path; and moving the folding member along a folding path extending transverse to the feed path, the folding path passing through the feed path, at the gap, and intercepting the feed path in folding juxtaposition with the forward edge of the platform;

locating the folding member relative to the cutting edge such that the folding member intercepts the feed path subsequent to interception of the cutting edge with the feed path as the cutting edge and the folding member are moved through the feed path and into the gap, to engage the folding member with a segment of the indeterminate length of foil extending between the forward edge of the platform and the severed edge of the indeterminate length of foil subsequent to severing the leaf from the indeterminate length of foil; and subsequently folding the segment about the forward edge, along a fold line formed in the indeterminate length of foil, as defined by and placed at the forward edge of the platform, to form a tab on the indeterminate length of foil, between the fold line and the severed edge of the indeterminate length of foil and folded over the indeterminate length of foil, while simultaneously forming, at the fold line, the leading edge of a next-consecutive foil leaf and providing a gripping site along the leading edge, reinforced by the folded-over tab.

2. The method of claim 1 wherein the indeterminate length of foil is advanced from the supply station until a desired selected length is placed at the delivery station, and the cutting edge and the folding member are moved subsequently to sever the leaf from the indeterminate length of foil and fold the segment about the forward edge.

3. The method of claim 1 wherein the cutting edge and the folding member are moved simultaneously along the respective cutting path and folding path.

4. The method of claim 3 wherein the simultaneous movement of the cutting edge and the folding member is a pivotal movement about a common pivotal axis.

5. The method of claim 1 wherein the foil is advanced along the feed path from a roll of foil placed at the supply station, the roll of foil being rotated in response to advancement of the foil along the feed path.

* * * * *